US005517288A

United States Patent [19]

Martin et al.

[11] Patent Number: 5,517,288

[45] Date of Patent: May 14, 1996

[54] TONER RIBBON DEVELOPMENT CASSETTE

[75] Inventors: Robert G. Martin; Edward W. Connors, both of Rochester; Fred W. Schmidlin, Pittsford, all of N.Y.

[73] Assignee: Xerox Corporation, Stamford, Conn.

[21] Appl. No.: 165,620

[22] Filed: Dec. 13, 1993

[51] Int. Cl.[6] ..... G03G 15/08

[52] U.S. Cl. ..... 355/260; 347/158

[58] Field of Search ..... 355/260, 245, 355/210; 346/155, 159; 118/653, 656; 347/158; 400/196

[56] References Cited

U.S. PATENT DOCUMENTS

| | | | |
|---|---|---|---|
| 2,786,441 | 3/1957 | Young | 118/657 |
| 3,613,636 | 10/1971 | Soures | 118/656 |
| 3,689,935 | 9/1972 | Pressman et al. | 346/74 ES |
| 3,728,963 | 4/1973 | Dowd | 400/196 X |
| 4,212,264 | 7/1980 | Knochtel et al. | 118/653 |
| 4,460,267 | 7/1984 | Ogawa | 355/3 DD |
| 4,491,855 | 1/1985 | Fujii et al. | 347/55 |
| 4,583,832 | 4/1986 | Kasamura et al. | 355/3 DD |
| 4,607,939 | 8/1986 | Saito | 355/3 DD |
| 4,647,180 | 3/1987 | Watanabe | 355/3 DD |
| 5,040,004 | 8/1991 | Schmidlin et al. | 346/159 |
| 5,196,870 | 3/1993 | Itoh et al. | 346/155 |
| 5,296,879 | 3/1994 | Kagayama | 347/152 X |

*Primary Examiner*—Joan H. Pendegrass

[57] ABSTRACT

Apparatus for creating powder images. An image forming member and a toner delivery system are supported opposite each other. The images are formed by the image forming member along a first direction. The toner delivery system includes a toner transport for moving toner particles from a supply to a zone opposite the image forming member. The transport moves along a second direction which is non-parallel to the first direction.

14 Claims, 3 Drawing Sheets

TONER RIBBON DEVELOPMENT CASSETTE

BACKGROUND OF THE INVENTION

This invention relates to dry type developing devices, usable with various types of image formation apparatus, for developing an electrostatic latent image, an electric potential latent image, a magnetic latent image or the like.

Of the various electrostatic printing techniques, the most familiar is that of xerography wherein latent electrostatic images formed on a charge retentive surface are developed by a suitable toner material to render the images visible, the images being subsequently transferred to plain paper.

A less familiar form of electrostatic printing is one that has come to be known as direct electrostatic printing (DEP). This form of printing differs from the aforementioned xerographic form, in that, the toner or developing material is deposited directly onto a plain (i.e. not specially treated) substrate in image configuration. This type of printing device is disclosed in U.S. Pat. No. 3,689,935 issued Sep. 5, 1972 to Gerald L. Pressman et al.

Pressman et al disclose an electrostatic line printer incorporating a multilayered particle modulator or printhead comprising a layer of insulating material, a continuous layer of conducting material on one side of the insulating layer and a segmented layer of conducting material on the other side of the insulating layer. At least one row of apertures is formed through the multilayered particle modulator. Each segment of the segmented layer of the conductive material is formed around a portion of an aperture and is insulatively isolated from every other segment of the segmented conductive layer. Selected potentials are applied to each of the segments of the segmented conductive layer while a fixed potential is applied to the continuous conductive layer. An overall applied field projects charged particles through the row of apertures of the particle modulator and the density of the particle stream is modulated according to the pattern of potentials applied to the segments of the segmented conductive layer. The modulated stream of charged particles impinge upon a print-receiving medium interposed in the modulated particle stream and translated relative to the particle modulator to provide line-by-line scan printing. In the Pressman et al device the supply of the toner to the control member is not uniformly effected and irregularities are liable to occur in the image on the image receiving member. High-speed recording is difficult and moreover, the openings in the printhead are liable to be clogged by the toner.

U.S. Pat. No. 5,040,004 granted to Frederic W. Schmidlin on Aug. 13, 1991 relates to a direct electrostatic printing apparatus including structure for delivering developer/toner particles to a printhead forming an integral part of the printing device. The developer/toner delivery system insures even distribution to an apertured printhead structure. To this end, toner is deposited on a donor belt using a magnetic brush structure. The belt is entrained about a drive roller and an idler roller as well as a stationary mandrel. The mandrel is positioned opposite the printhead structure with a portion of the belt disposed intermediate thereof. The mandrel is provide with a flat area which is coplanar with the printhead structure. The flat area is coextensive with the space occupied by a plurality rows of apertures in the printhead to thereby provide a uniform spacing between each row of apertures and the toner delivery belt.

U.S. Pat. No. 4,460,267 issued on Jul. 17, 1984 relates to a developing device mountable into and demountable from an image formation apparatus. It includes a housing provided with an aperture, a shutter assuming a position to close the aperture when the device is mounted in the image formation apparatus, and a position to open the aperture when the device is not mounted in the image formation apparatus.

U.S. Pat. No. 4,647,180 issued on Mar. 3, 1987 discloses a developing device constructed so that a developing agent resupply section is located side by side with a developing chamber, and a feed member for feeding a developing agent into the developing chamber is disposed in the developing agent resupply section.

U.S. Pat. No. 4,607,939 issued on Aug. 26, 1986 discloses a removable developing unit of an electrostatic recording apparatus, particularly a multi-color copying apparatus, having a casing with an aperture, at one side to allow contact of a developing sleeve with a photoconductive member when the developing unit is mounted in the copying apparatus. A cover and an automatic closing mechanism is provided so that the aperture is covered when the developing unit is removed from the copying apparatus. The casing includes a toner hopper to which a replaceable toner cartridge is attached. The correct color of replacement toner for the developing unit is ensured by removable tabs or openings on the toner hopper which matches those of the correct color toner cartridge.

U.S. Pat. No. 4,212,264 issued on Jul. 15, 1980 discloses an apparatus for supplying electrophotographic developer to an electrophotographic developing device is disclosed. The developer supply apparatus includes a cartridge containing therein an amount of developer and supported within the housing of the supply apparatus in a manner that the cartridge is allowed to move rotationally and reciprocally around and along its axis. The cartridge has an opening at its one end and also a plural number of ribs provided within the cartridge. During the movement of the cartridge, the ribs stir the developer contained in the cartridge and also cause the developer to move toward the opening. The cartridge is brought into motion responding to a supply signal so as to effect a supply of developer from the cartridge to the developing device.

U.S. Pat. No. 4,583,832 issued on Apr. 22, 1986 discloses developing device adapted to be removably mounted with respect to an image forming apparatus, there are provided protective cover members for covering and protecting a developing sleeve for developing a latent image on an image bearing member and spacer rollers for maintaining the gap between the image bearing member and the developing sleeve at a predetermined distance. Opening/closing of these protective cover members is effected in response to operation of a member such as a handle which is capable of being drawn out with respect to the developing device.

Toner belt type development systems similar to the ones discussed above are normally contact devices configured to operate in the machine process direction to avoid image smear. This given parameter establishes a toned belt width of at least nine inches to accommodate a minimum 8.5×11 inch copy sheet and increases with paper size and feed direction. The belt circumference can become substantial as it is most often designed to accommodate its toner supply system. Such developer systems must also accommodate the rolls required for belt tracking, and for driving and for supporting the belt for movement in the copier or printer. Due to the problem of belt tracking in a toner environment, part count, cost and a limited need for such a system, donor belt mechanisms have not been used extensively in present copier/printer applications.

Future and present machines considering non-contact jumping toner development that may require color capability in a confined space, with high reliability, and special applications such as Direct Printing may require the features provided by the present invention.

BRIEF SUMMARY OF THE INVENTION

The present invention provides a developer or toner delivery system in the form of a Customer Replaceable Unit (CRU) similar in appearance to an oversized video recording cassette. The cassette is used to deliver toner particles to an image forming device which may be an image receptor such as a photoreceptor of the type used in xerography or it may comprise a direct electrostatic printhead (DEP).

The cassette has a toner transport belt contained therein as well as rollers for supporting the belt's movement in an endless path. One of the support rollers also serves as a drive roller for effecting movement of the belt along a predetermined path.

A supply of dry developer including toner particles is contained in a sump area in the cassette as well as a developer donor system for transporting the toner particles from the sump to a nip area between the donor system and the belt. The toner attracted to the belt is then transported by the belt to a development zone intermediate the cassette and an image receptor. An elongated opening in the cassette adjacent the development zone allows the toner particles to be propelled from the belt to the image receptor. Jumping development may be utilized to jump the toner particles from the developer belt to the imaging surface.

The cassette is mounted in a reproducing machine in a orientation which positions the toner belt along a line which intersects the path of movement of the image receptor. For low volume usage the cassette may be mounted such that the belt moves in a direction perpendicular to the image receptor's path of movement path of movement. With some printing systems in order to avoid the pitfall of toner starvation exhibited when developing at 90 degrees to the process direction over an extended nip length, the cassette is mounted in the copier/printer at an angle or skewed relationship so as to provide new toner to the nip at all times. This skew coupled with a proper belt process speed eliminates the possibility of toner starvation.

DETAILED DESCRIPTION OF THE DRAWINGS

DESCRIPTION OF THE PREFERRED EMBODIMENT OF THE INVENTION

While the present invention will be disclosed in connection with a direct electrostatic printing device it will be appreciated that it can be utilized in various other imaging machines for developing electrostatic images with toner particles.

Figure 4:
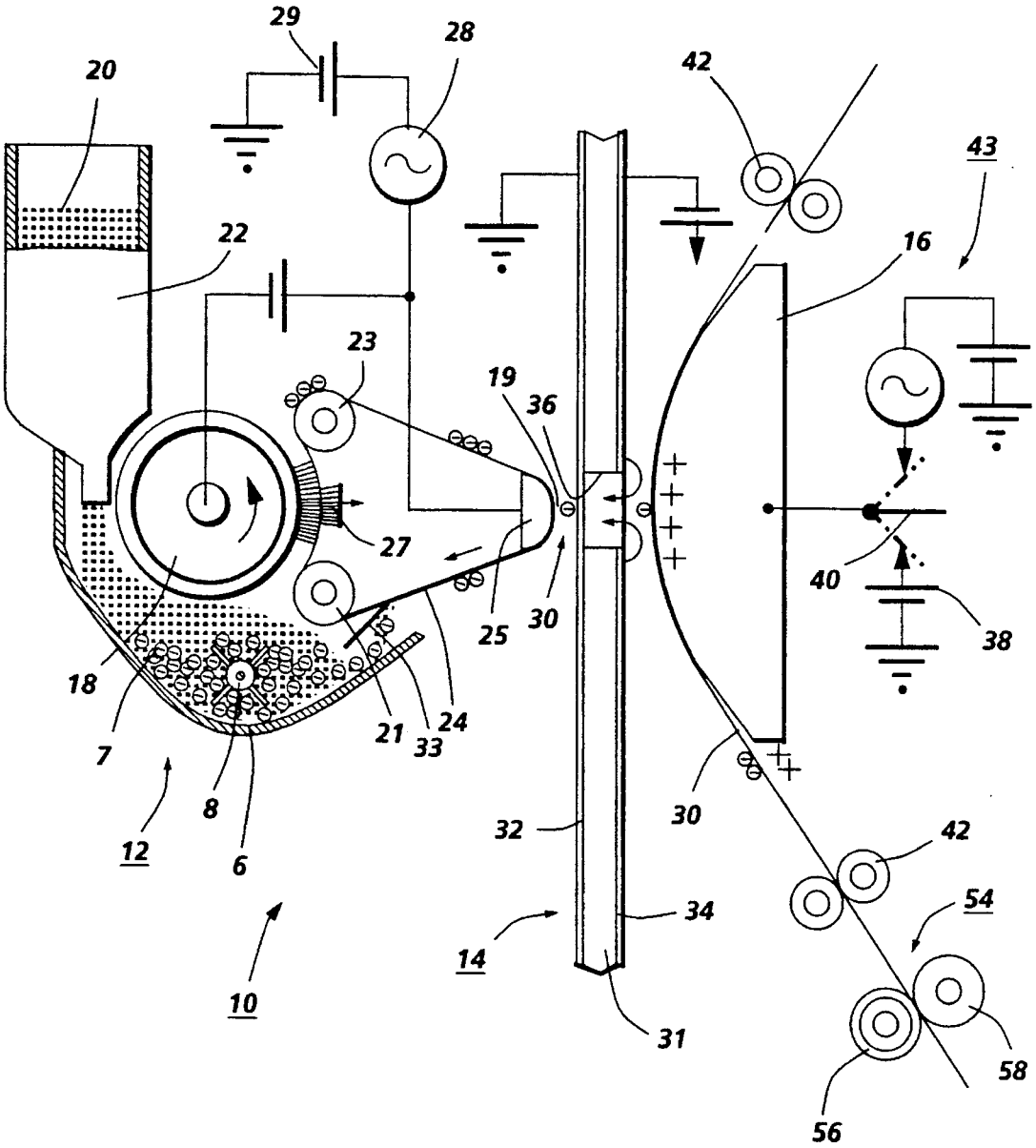
PRIOR ART FIG. 4
FIG. 4 is a schematic view of a printing device in which the developer delivery system of the present invention may be utilized.

Disclosed in FIG. 4 is an embodiment of a direct electrostatic printing apparatus 10. The printing apparatus 10 includes a delivery system generally indicated by reference character 12, an image forming device or printhead structure 14 and a backing electrode or shoe 16.

The developer delivery system 12 includes a conventional magnetic brush 18 supported for rotation adjacent a supply of toner 20 contained in a hopper 22. A developer donor belt 24 is supported for movement intermediate the magnetic brush 18 and the printhead structure 14. The donor belt structure which is preferably fabricated of polyvinyl fluoride doped with carbon black is spaced from the printhead approximately 0.003 to 0.015 inch. The magnetic brush has a DC bias of about 100 volts applied thereto via a DC voltage source 26. A grounded conductive brush 27 contacts the inside of the belt 24 opposite the side contacted by the developer brush 18. An AC voltage of about 400 volts provided by source 28 with a DC bias of 20 volts provided by source 29 is applied to the mandrel 25. The applied voltages are effective to cause attraction of toner from the brush 18 and to cause transfer of a monolayer of toner to the donor belt 24 from the brush 18. The monolayer is subsequently jumped to the vicinity of the apertures of the printhead. The 20 volts DC bias precludes collection of right sign toner on the shield electrode of the printhead. A suitable DC bias is applied to the donor roll The toner 20 enters a developer housing 6 where it is mixed with carrier particles 7 by means of a paddle wheel 8. The toner is dispensed from the hopper 22 as it is depleted from the mixture of carrier and toner in the housing 6. Control of the toner dispensed from the housing may be accomplished in accordance with well known techniques in the art.

Figure 2:
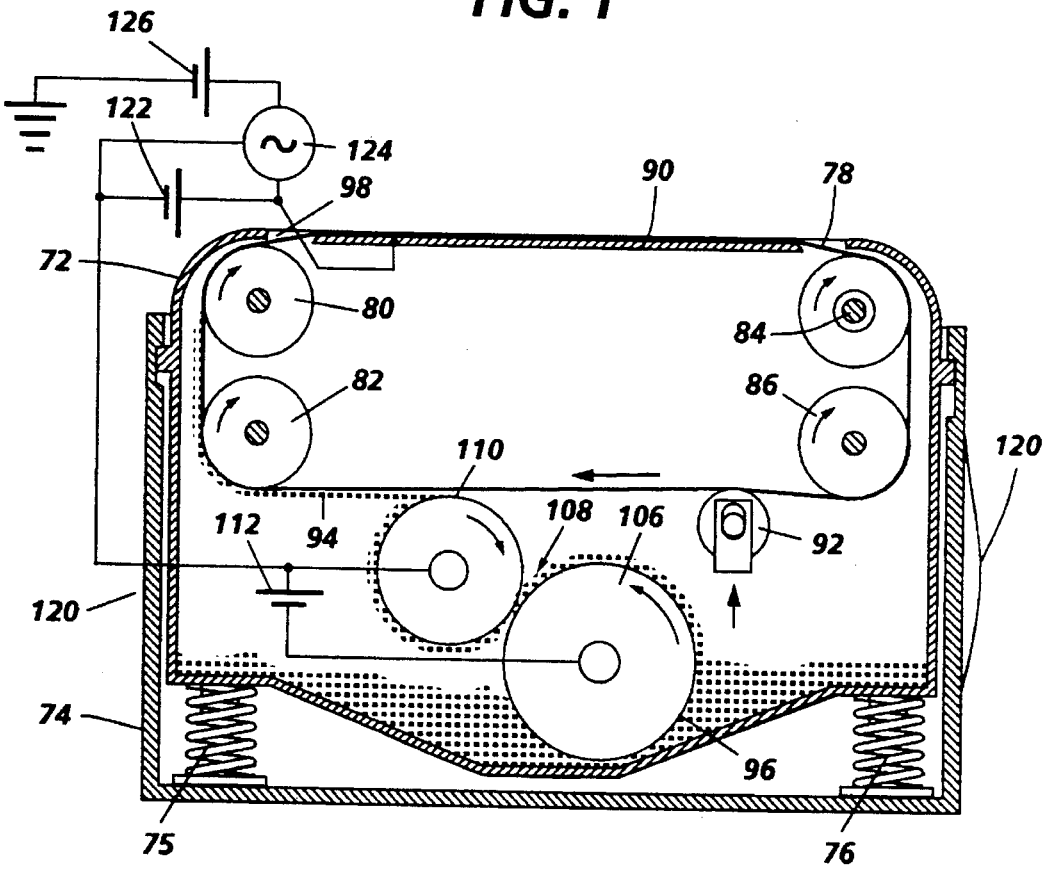
FIG. 2 is a elevational view of a developer delivery cassette according to the invention.

The donor belt 24 is entrained about a drive roller 21, idler roller 23 and a stationary mandrel 25. The mandrel 25 is provided with a flat area 19 and the mandrel is positioned such that the flat area is disposed adjacent the rows of apertures in the printhead structure. With the belt moving over the flat area a nip area 30 is formed intermediate the belt and the printhead. The flat area coplanar with the printhead structure is coextensive (FIG. 2) with the space occupied by the rows of apertures in the printhead to thereby provide a uniform spacing across the nip whereby the spacing between each row of apertures and the toner delivery belt is uniform. A scraper 33 contacting the belt 24 at an angle serves to scrape unused toner from the belt. The toner so removed falls into a housing, not shown, from where it can be returned to the hopper 22 by a toner transport, not shown.

The developer preferably comprises any suitable insulative non-magnetic toner/carrier combination having Aerosil (Trademark of Degussa, Inc.) contained therein in an amount equal to ½% by weight and also having zinc stearate contained therein in an amount equal to 3% by weight.

The printhead structure 14 comprises a layered member including an electrically insulative base member 31 fabricated from a polyimide film approximately 0.001 inch thick. The base member is clad on the one side thereof with a continuous conductive layer or shield 32 of aluminum which is approximately one micron thick. The opposite side of the base member 30 carries segmented conductive layer 34 thereon which is fabricated from aluminum. A plurality of rows of holes or apertures 36 (only one of which is shown) are provided in the layered structure in a pattern suitable for use in recording information. The apertures form an electrode array of individually addressable electrodes. With the shield grounded and zero to +50 volts applied to an addressable electrode, toner is propelled through the aperture associated with that electrode. The aperture extends through the base 31 and the conductive layers 32 and 34.

With a negative 300 volts applied to an addressable electrode toner is prevented from being propelled through the aperture. Image density can be varied by adjusting the voltage on the control electrodes between 0 and minus 300 volts. Addressing of the individual electrodes can be effected in any well known manner know in the art of printing using electronically addressable printing elements.

The electrode or shoe 16 has an arcuate shape as shown but as will be appreciated, the present invention is not limited by such a configuration. The shoe which is positioned on the opposite side of a plain paper recording medium 30 from the printhead deflects the recording medium in order to provide an extended area of contact between the medium and the shoe.

The recording medium 30 may comprise cut sheets of paper fed from a supply tray 40. The sheets of paper which are spaced from the printhead 14 a distance in the order of 0.003 to 0.030 inch as they pass therebetween. The sheets 30 are transported in contact with the shoe 16 via edge transport roll pairs 42.

The apertures selected or addressed during the printing operation form the toner particles provided by the toner delivery system into images along the longitudinal axis of the printhead structure which images are propelled through the apertures onto the recording medium 30 which, by way of example, is plain paper.

During printing the shoe 16 is electrically biased to a DC potential of approximately 400 volts via a DC voltage source 38.

Periodically, between printed pages, a switch 40 is actuated in the absence of a sheet of paper between the printhead and the shoe such that a DC biased AC power supply 43 is connected to the shoe 16 to effect cleaning of the printhead. The voltage supplied by the source 43 is of the same frequency as that (i.e. source 28) used to jump the toner from the toner supply system but it is 180 degrees out of phase with it. This causes the toner in the gap between the paper and the printhead to oscillate and bombard the printhead.

Momentum transfer between the oscillating toner and any toner on the control electrodes of the printhead causes the toner on the control electrodes to become dislodged. The toner so dislodged is deposited on the substrates subsequently passed over the shoe 16.

At the fusing station, a fuser assembly, indicated generally by the reference numeral 54, permanently affixes the transferred toner powder images to sheet 30. Preferably, fuser assembly 54 includes a heated fuser roller 56 adapted to be pressure engaged with a back-up roller 58 with the toner powder images contacting fuser roller 56. In this manner, the toner powder image is permanently affixed to copy substrate 30. After fusing, a chute, not shown, guides the advancing sheet 30 to catch tray (not shown) for removal from the printing machine by the operator.

Figure 1:
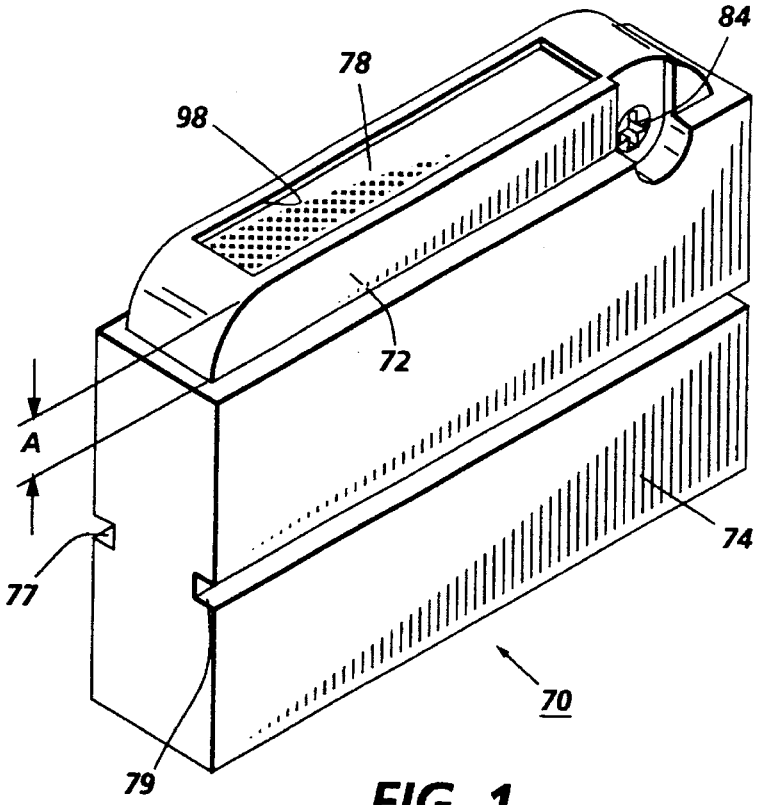
FIG. 1 is a perspective view of a developer delivery system according to the invention.

Pursuant to the intents and purposes of the present invention as illustrated in FIG. 1, the developer delivery system 12 (FIG. 4) is replaced by a developer cassette in the form of a customer replaceable unit (CRU) 70. The cassette 70 comprises a member 74 inserted into a base member 72. Assembly of the two members 72 and 74 may be accomplished utilizing well know assembly techniques. This cassette may be visualized as being similar in appearance to film recording cassette. As shown, member 74 of the cassette is spring biased via springs 75, 76 to its operative position as show in FIG. 2. Grooves 77 and 79 are provided in the outer walls of the base member 74 for installation of the cassette into a machine.

An endless development belt structure 78 is supported for endless movement by four rollers or pulleys 80, 82, 84 and 86, one of the rollers, for example 84, serving as a drive roller for effecting movement of the belt. The belt structure is fabricated from a polyamide and a ground plane 90 is supported such that the belt moves thereover, the ground plane being provided for applying an electrical bias. A belt tensioning roller 92 serves to take up any undue slack in the belt during operation. The belt structure serves to transport toner particles 94 from a developer supply 96 contained in member 74 to an opening 98 in the member 74. In operation, toner particles carried by the belt structure are propelled from the belt through the opening 98 which is disposed opposite an image forming member such as the printhead structure 14. As will be appreciated, the image forming member may also comprise a photosensitive member containing latent electrostatic images.

Two component developer containing toner particles 94 and carrier particles are transported using a magnetic brush member 106 to a nip area 108 intermediate the magnetic brush and a donor roll 110. In the nip area 108, toner particles 94 are deposited on the donor roll 110 with the aid of an electrical bias 112 provided between the two rolls. The electrical bias 112 as well as other electrical circuits are operatively connected to a connector plug 120 carried by the base member 72. A mating connector disposed internally of the machine in which the cassette is used serves to provide electrical power to each of the electrical components forming a part of the cassette.

A DC bias of about 100 volts is applied to the donor roll via electrical bias 122 for creating a suitable electrostatic field between the donor roll and the belt structure for effecting deposition of toner particles on the belt. An AC voltage of about 400 volts provided by source 124 with a DC bias of about 20 volts provided by source 126 is applied to the ground plane 90. The applied voltages are effective to cause transfer of a monolayer of toner to the developer belt structure 78 from the donor roll 110. The monolayer is subsequently jumped to the vicinity of the apertures of the printhead structure 14. The 20 volts DC bias precludes collection of right sign toner on the shield electrode of the printhead.

Figure 3:
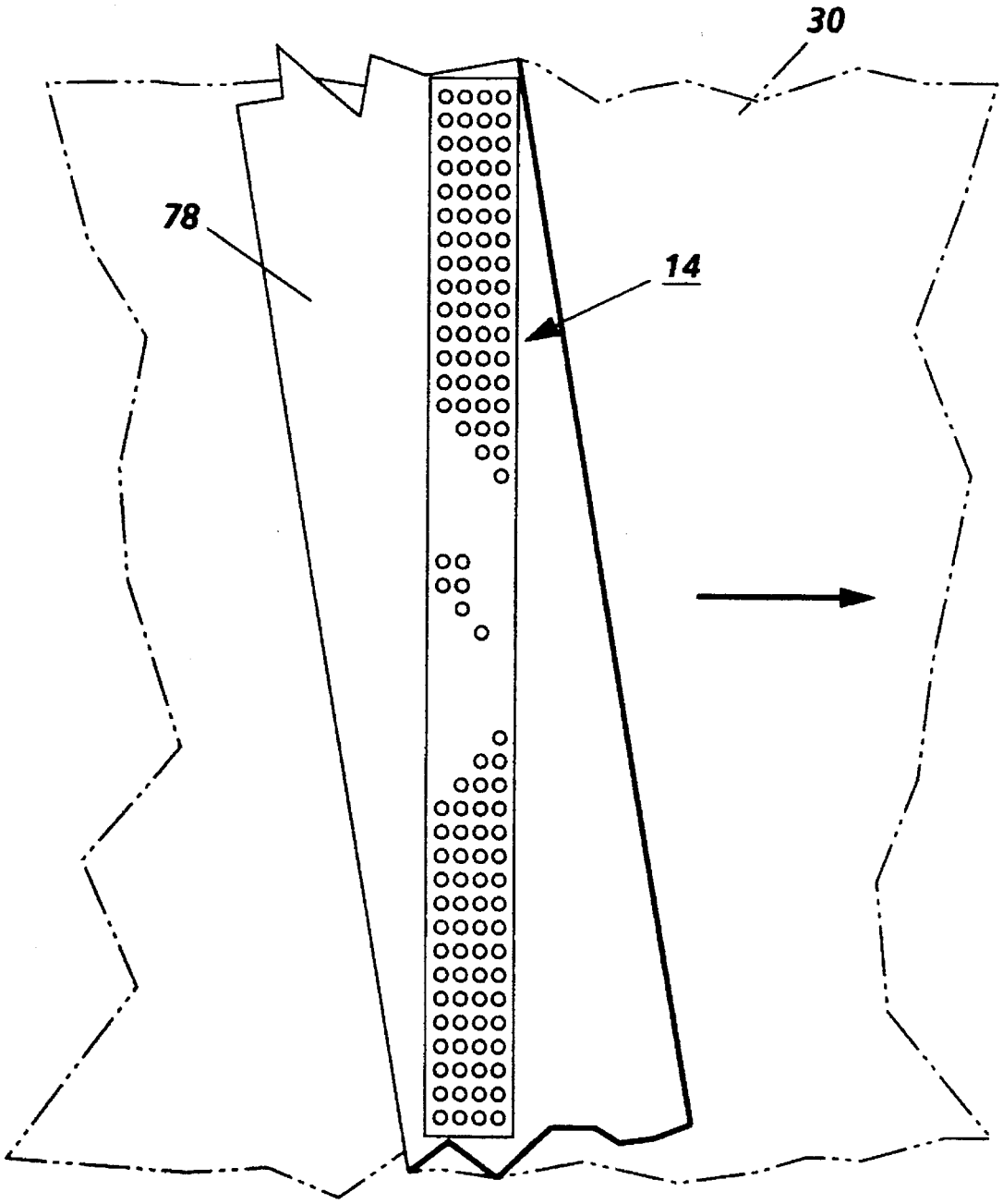
FIG. 3 is an illustration depicting the relative positioning of a printhead and a toner belt transport.

To avoid the possibility of toner starvation when developing at 90° to the image process direction over an extended nip length, the cassette is mounted in the copier/printer at such an angle (FIG. 3) as to provide new toner to the nip at all times. This skew coupled with a proper film/process speed would eliminate the possibility of toner starvation.

Suitable seals, not shown, may be provided between the members 72 and 74 and base members 72 and 74 for preventing unwanted escape of developer material from the cassette.

The belt structure is relatively narrow,for example in the order of 1.25–2.00" wide. Thus, it can be run on spools and guide blocks to eliminate belt tracking mechanisms. Belt stretching would also be minimized by this construction and the use of a metal belt made practical.

We claim:

1. Apparatus for creating powder images, said apparatus comprising:

means for forming toner into images which extend in a first direction;

a toner delivery system, comprising a stationarily mounted housing including therein means for transporting toner particles from a supply of toner particles to a zone intermediate said means for forming toner into images and said toner delivery system;

means supporting said toner delivery system such that said transport moves in a nonparallel direction relative to said first direction; and said housing being substantially coextensive with the extent of said nonparallel direction.

2. Apparatus according to claim 1 wherein said means for forming an image comprises an image receptor.

3. Apparatus according to claim 2 wherein said toner delivery system comprises a cassette.

4. Apparatus according to claim 3 wherein said transport comprises an endless belt.

5. Apparatus according to claim 4 wherein said belt is narrow relative to said image receptor.

6. Apparatus according to claim 1 wherein said imaging forming means comprises a direct electrostatic printhead.

7. Apparatus according to claim 6 wherein said toner delivery system comprises a cassette.

8. Apparatus according to claim 7 wherein said transport comprises an endless belt.

9. Apparatus according to claim 8 wherein said belt is narrow relative to said images receptor.

10. Apparatus according to claim 9 wherein said supply comprises two component developer.

11. A method of delivering toner particles to means for forming the toner images into images extending in a first direction, said method including the steps of:

moving toner in a direction at a skewed angle to said first direction.

12. The method according to claim 11 wherein said step of moving toner at an angle is effected using a cassette.

13. The method according to claim 12 wherein said step of moving toner at an angle is effected using an endless belt contained in said cassette.

14. The method according to claim 13 wherein said belt is narrow compared to the extent of said belt.

* * * * *